US011648697B2

(12) United States Patent
Long

(10) Patent No.: US 11,648,697 B2
(45) Date of Patent: May 16, 2023

(54) SHAVING RAZOR CARTRIDGE

(71) Applicant: The Gillette Company LLC, Boston, MA (US)

(72) Inventor: Matthew Michael Long, Methuen, MA (US)

(73) Assignee: The Gillette Company LLC, Boston, MA (US)

( * ) Notice: Subject to any disclaimer, the term of this patent is extended or adjusted under 35 U.S.C. 154(b) by 429 days.

(21) Appl. No.: 16/367,324

(22) Filed: Mar. 28, 2019

(65) Prior Publication Data

US 2019/0299457 A1 Oct. 3, 2019

Related U.S. Application Data

(60) Provisional application No. 62/650,375, filed on Mar. 30, 2018.

(51) Int. Cl.

| | |
|---|---|
| ***B26B 21/02*** | (2006.01) |
| ***B26B 21/40*** | (2006.01) |
| *B26B 21/22* | (2006.01) |
| *B26B 21/44* | (2006.01) |

(52) U.S. Cl.

CPC ..... *B26B 21/4012* (2013.01); *B26B 21/02* (2013.01); *B26B 21/222* (2013.01); *B26B 21/4018* (2013.01); *B26B 21/443* (2013.01)

(58) Field of Classification Search

CPC ..... B26B 21/4012

See application file for complete search history.

(56) References Cited

U.S. PATENT DOCUMENTS

| | | | | |
|---|---|---|---|---|
| 2009/0193659 | A1 | 8/2009 | Park | |
| 2009/0293281 | A1* | 12/2009 | Bruno | B26B 21/222 30/50 |
| 2011/0146079 | A1 | 6/2011 | Clarke | |
| 2016/0279816 | A1 | 9/2016 | Bruno | |
| 2016/0361827 | A1 | 12/2016 | Bruno | |

FOREIGN PATENT DOCUMENTS

| | | | |
|---|---|---|---|
| CN | 102216038 | A | 10/2011 |
| CN | 106956296 | A | 7/2017 |
| CN | 107000231 | A | 8/2017 |
| JP | 2018507737 | A | 3/2018 |

OTHER PUBLICATIONS

International Search Report PCT/US2019/023064 dated Mar. 20, 2019, 12 pages.

* cited by examiner

*Primary Examiner* — Evan H MacFarlane
*Assistant Examiner* — Liang Dong
(74) *Attorney, Agent, or Firm* — John M. Lipchitz

(57) ABSTRACT

A shaving razor cartridge with a housing having a blade platform. A first blade retention member is positioned on the blade platform and has a front wall formed by a first wall and a second wall that define an obtuse included angle. A second blade retention member is positioned on the blade platform and has a rear wall facing the front wall of the first blade retention member. The rear wall has a first wall and a second wall that define an obtuse included angle. A blade member is positioned between the front wall and the rear wall. The second walls have a contact length of about 0.2 mm to about 1.0 mm.

17 Claims, 8 Drawing Sheets

SHAVING RAZOR CARTRIDGE

FIELD OF THE INVENTION

The present invention relates to wet shaving safety razors and more particularly to shaving razor cartridges that have a housing for retaining and/or rigidly fixing one or more blades to the housing.

BACKGROUND OF THE INVENTION

In general, a cartridge or blade unit of a safety razor has at least one blade with a cutting edge which is moved across the surface of the skin being shaved by means of a handle to which the cartridge is attached. Some shaving razors are provided with a spring biased cartridge that pivots relative to the handle to follow the contours of the skin during shaving. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled. Razor cartridges usually include a guard which contacts the skin in front of the blade(s) and a cap for contacting the skin behind the blade(s) during shaving. The cap and guard may aid in establishing the so-called "shaving geometry", i.e., the parameters which determine the blade orientation and position relative to the skin during shaving, which in turn have a strong influence on the shaving performance and efficacy of the razor. The cap may comprise a water leachable shaving aid to reduce drag and improve comfort. The guard may be generally rigid, for example formed integrally with a frame or platform structure which provides a support for the blades. Guards may also comprise softer elastomeric materials to improve skin stretching.

Wet shaving razors have evolved over the years to include unitary blade members that do not require a blade to be welded to a bent blade support member. These unitary blade members are typically thinner than the previous bent blade support members. It is often difficult to maintain the unitary blade members within the housing securely during repeated shaving strokes because the unitary blade members tend to move in cap-guard direction during a shaving. Movement of the unitary blade members during a shaving stroke can lead to shaving inefficiency and increased nicks and cuts. Similar problems may also occur with welded blade assemblies (i.e., a bent blade support with a welded blade). Thus, there is a need for a safety shaving razor having a housing to minimize movement of the blades during a shaving stroke.

SUMMARY OF THE INVENTION

In one aspect, the invention features, in general a shaving razor cartridge with a housing having a blade platform. A first blade retention member is positioned on the blade platform and has a front wall with a first lateral end, a second lateral end and a blade support region between the first lateral end and the second lateral end of the first blade retention member. A second blade retention member is positioned on the blade platform and has a rear wall facing the front wall of the first blade retention member. The rear wall having a first lateral end. A second blade retention member has a rear wall facing the front wall of the first blade retention member. The rear wall having a first lateral end, a second lateral end and a blade support region between the first lateral end and the second lateral end of the rear wall of the second blade retention member. The first lateral ends are spaced apart by a first vertical distance. The second lateral ends are spaced apart by a second vertical distance. The blade support regions are spaced apart by a third vertical distance that is less than the first vertical distance.

In another aspect, the invention features, in general a shaving razor cartridge with a housing having a blade platform. A first blade retention member is positioned on the blade platform and has a front wall formed by a first wall and a second wall that define an obtuse included angle. A second blade retention member is positioned on the blade platform and has a rear wall facing the front wall of the first blade retention member. The rear wall has a first wall and a second wall that define an obtuse included angle. A blade member is positioned between the front wall and the rear wall. The second walls have a contact length of about 0.2 mm to about 1.0 mm.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1:
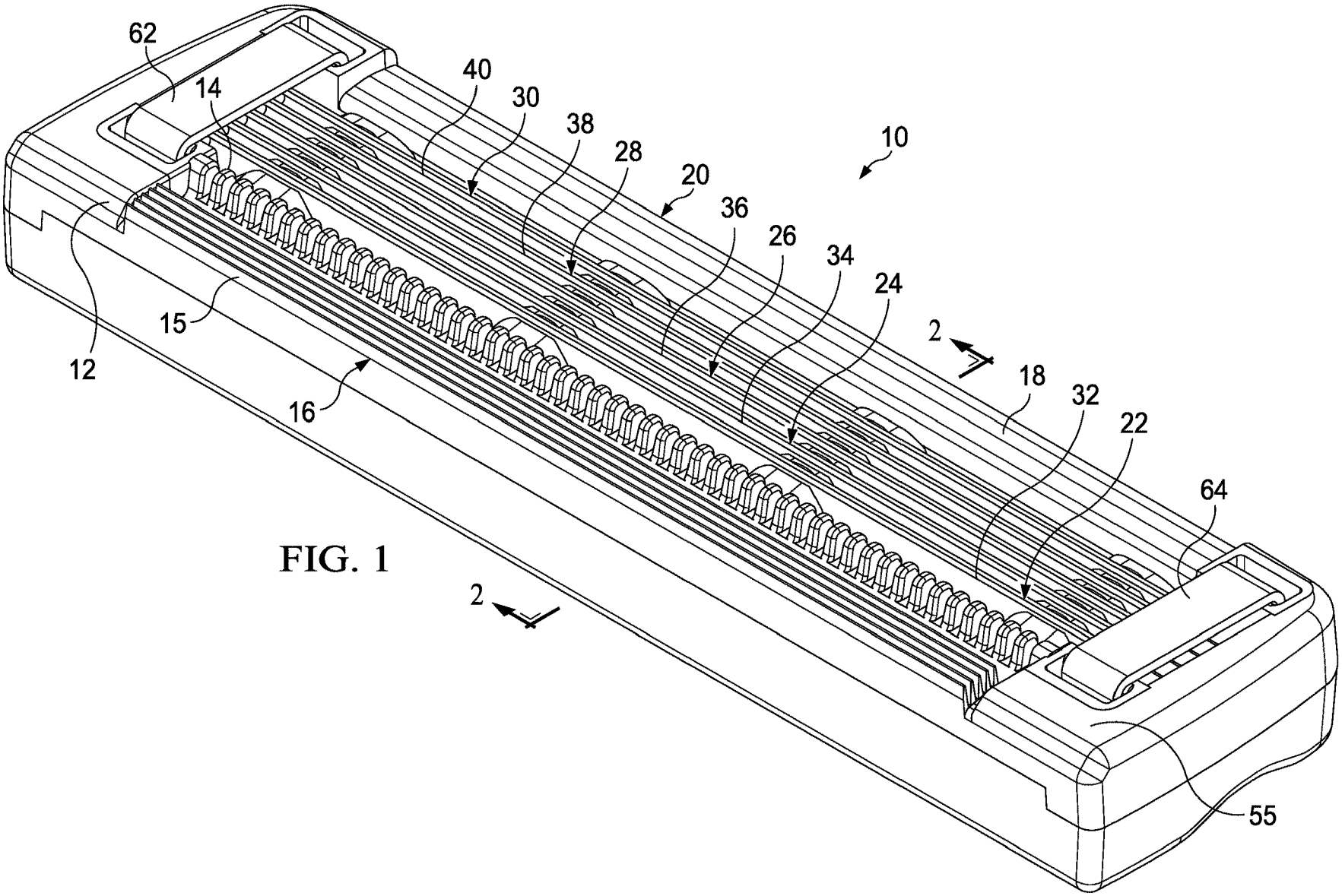
FIG. 1 is a perspective view of a shaving razor cartridge according to one possible embodiment of the present invention.

Referring to FIG. 1, a perspective view of a shaving razor cartridge 10 is shown. The shaving razor cartridge 10 may be mounted to a handle (not shown). The shaving razor cartridge 10 may be removable or permanently mounted to the handle. For example, the shaving razor cartridge 10 may be mounted detachably on a handle to enable the shaving razor cartridge 10 to be replaced by a fresh shaving razor cartridge 10 when the blade sharpness has diminished to an unsatisfactory level, or it may be attached permanently to the handle with the intention that the entire razor be discarded when the blade or blades have become dulled. The shaving razor cartridge may include a housing 12. The housing 12 may be molded out of a rigid plastic or manufactured from other materials, such as metal. A guard 14 may be positioned at a front portion 16 of the housing and a cap 18 may be positioned at a rear portion 20 of the housing 12. The guard 14 is typically a unitary molded member that can be formed of a rigid plastic (e.g., the same material as the housing 10). In certain embodiments, the cap 18 may comprise one or more lubricants that are released during a shaving stroke.

One or more blade members 22, 24, 26, 28 and 30 may be mounted to the housing 12 between the cap 18 and the guard 14 (i.e., in front of the cap 18 and behind the guard 14). The blade members 22, 24, 26, 28, and 30 may each have a respective cutting edge 32, 34, 36, 38, and 40 generally directed towards the guard 14. A primary blade member 22 may be nearest the guard 14, secondary blade 24 is next nearest the guard 14, and so on until the fifth blade 30 is furthest from the guard 14. Although five blade members 22, 24, 26, 28 and 30 are shown, the housing 12 may have more or fewer blades depending on the desired performance and cost of the shaving razor cartridge 10. The guard 14 and the cap 18 may define a shaving plane that is tangent to the guard 14 and the cap 18. The guard 14 may be a solid or segmented bar that extends generally parallel to the blade members 22, 24, 26, 28 and 30 and supports the skin during a shaving stroke. In certain embodiments, the housing 12 may comprise a skin-engaging member 15 (e.g., a plurality of fins or other protrusions) in front of the guard 14 for stretching the skin during a shaving stroke. In certain embodiments, the skin-engaging member 15 may be insert injection molded or co-injection molded to the housing 12. However, other known assembly methods may also be used such as adhesives, ultrasonic welding, or mechanical fasteners. The skin engaging member 15 may be molded from a softer material (i.e., lower durometer hardness) than the housing 12, such as an elastomer.

In certain embodiments, the blades 22, 24, 26, 28 and 30 may be mounted to the housing 12 and secured by one or more clips 62 and 64 located at opposite lateral sides of the housing 12. The blade members 22, 24, 26, 28 and 30 may be fixed in the housing 12 or may be resiliently mounted such that the blade members 22, 24, 26, 28 and 30 (e.g., respective cutting edge 32, 34, 36, 38, and 40) are biased against the clips 62 and 64. The clips 62 and 64 may aid in retaining the blades 22, 24, 26, 28 and 30 in an up and down direction (i.e., toward and away from a top surface 55 of the housing 12). Each of the clips 62 and 64 extend thru the housing 12 or wrap around the housing 12. The clips 62 and 64 may comprise a metal, such as aluminum or plastic. The clips 62 and 64 may also be interconnected to form a one piece assembly. Other assembly methods known to those skilled in the art may also be used to secure and/or mount the blades members 22, 24, 26, 28 and 30 to the housing 12 including, but not limited to, wire wrapping, cold forming, hot staking, insert molding, ultrasonic welding, and adhesives.

Figure 2:
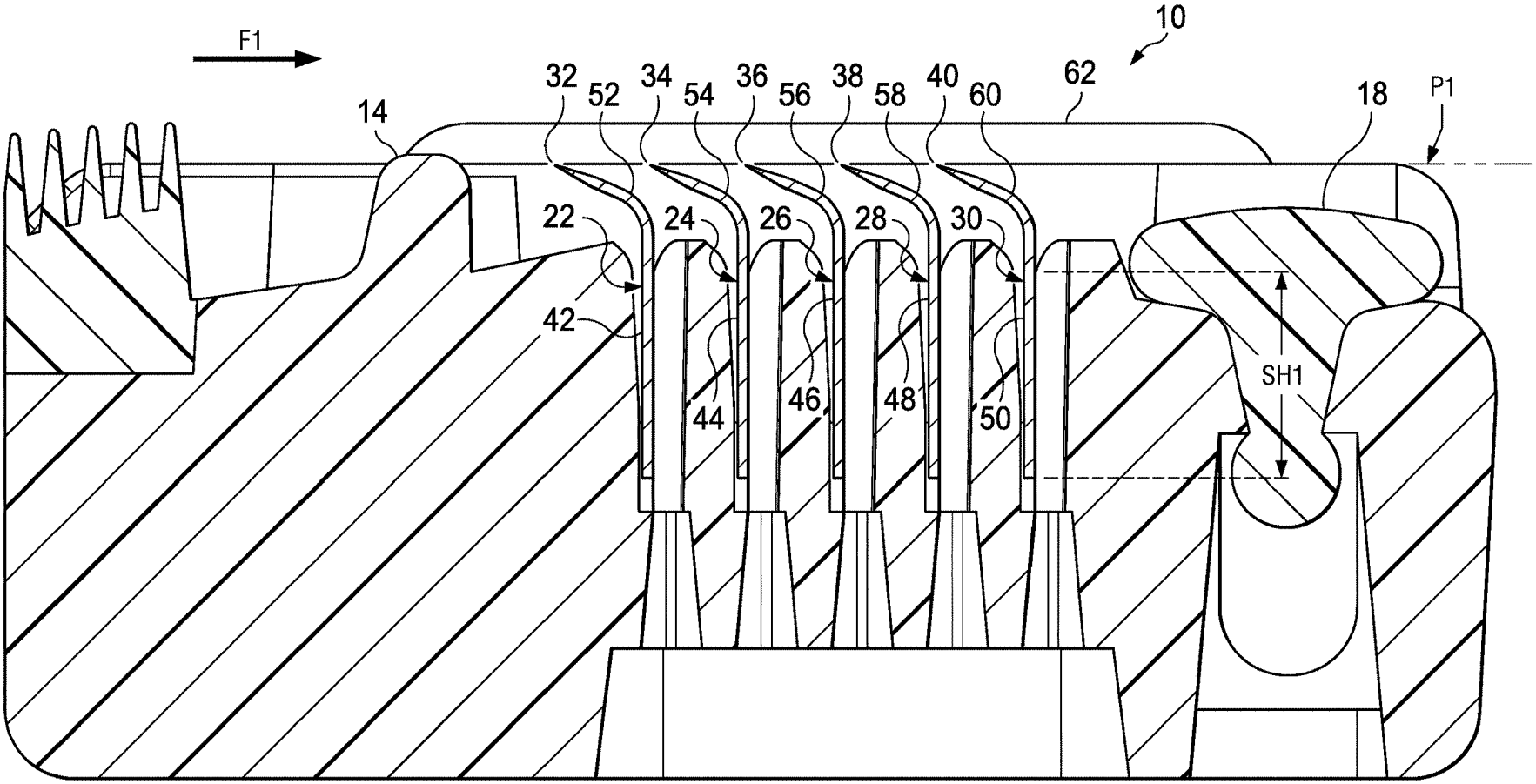
FIG. 2 is a cross section view of the shaving razor cartridge, taken generally along the line 2-2 of FIG. 1

Referring to FIG. 2, a cross section of the shaving cartridge 10 is shown, taken generally along the line 2-2 of FIG. 1. One or more of the blade members 22, 24, 26, 28 and 30 may be a bent blade unit. For example, each blade members 22, 24, 26, 28 and 30 may comprise a unitary member having a base portion 42, 44, 46, 48, 50 and respective bent portion 52, 54, 56, 58, 60 located between the respective cutting edge 32, 34, 36, 38, 40 and the base portion 42, 44, 46, 48, 50. The base portions 42, 44, 46, 48, 50 may be generally parallel to each other and transverse to a shaving plane P1 that is tangent to the guard 14 and the cap 18. In other embodiments, the one or more of the blades may be welded blade assemblies (e.g., a blade welded having a cutting edge connected to a blade support having a base portion and a bent portion). FIG. 2 illustrates shaving forces F1 may exert a force on the blade members 22, 24, 26, 28 and 30 in a direction from the guard 14 toward the cap 18. Accordingly, the blades 22, 24, 26, 28 and 30 may rock backwards toward the cap 18 during a shaving stroke. The movement of the blades members 22, 24, 26, 28 and 30 may increase as the thickness and rigidity of the blade members 22, 24, 26, 28 and 30 decreases. The blade members 22, 24, 26, 28 and 30 may have a support height "SH1" of about 1.5 mm to about 2.5 mm. For example, the height of the portion of the blade, such as the base 42, that is supported and or contacted by the housing 12.

Figure 3:
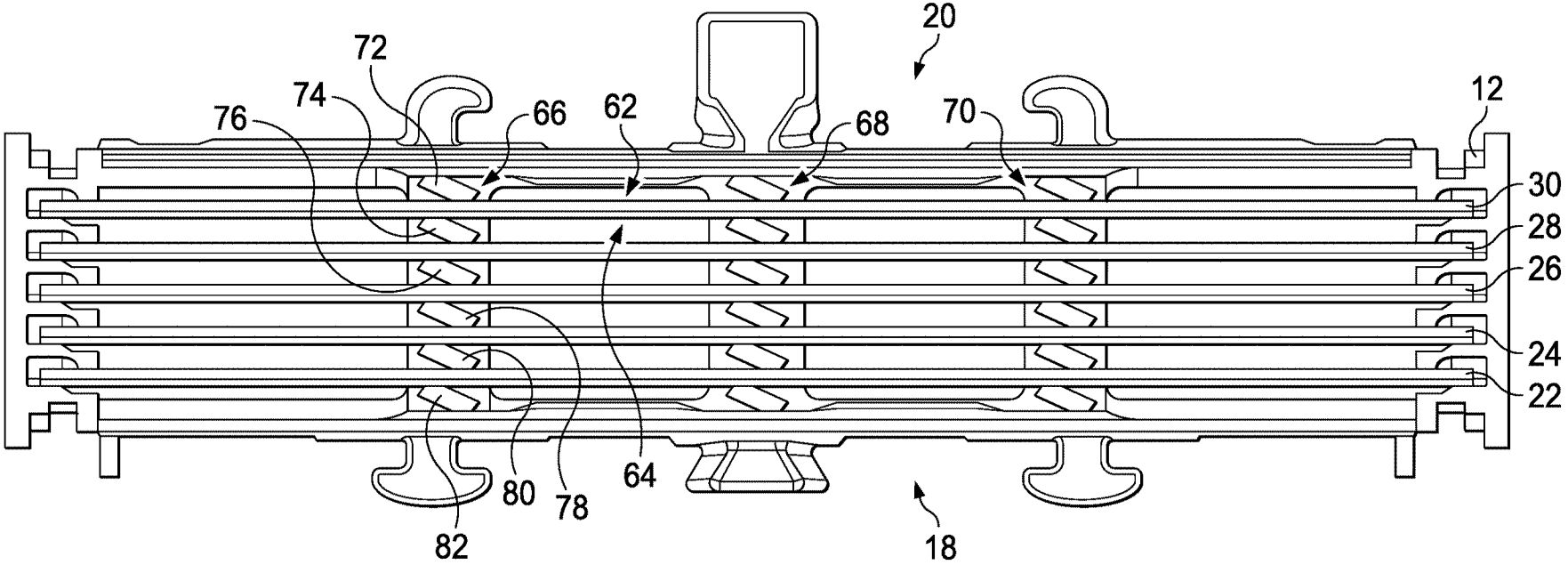
FIG. 3 is a top view of a first possible embodiment of a housing with a plurality of blade members that may be incorporated into the shaving razor cartridge of FIG. 1.

Referring to FIG. 3, a top view of the blade members 22, 24, 26, 28 and 30 mounted to the housing 12 is illustrated. Each of the blade members 22, 24, 26, 28 and 30 may have a first surface and a second surface. For example, the blade member 30 may have a first surface 62 and a second surface 64. The first surface 62 may face toward the rear portion 20 of the housing 12 and the second surface 64 may face toward the front portion 18 of the housing 12. The housing 12 may have one or more blade platforms 66, 68 and 70 extending from the rear portion 20 of the housing 12 toward the front portion 18. Although three platforms are shown, more or less platforms may be used depending on the desired level of support for the blade members 22, 24, 26, 28 and 30. Each blade platform 66, 68 and 70 may have a plurality of blade retention members. For example, the blade platform 66 may have a first blade retention member 72, a second blade retention member 74, a third blade retention member 76, a fourth blade retention member 78, a fifth blade retention member 80 and a sixth blade retention member 82. One of the blade members 22, 24, 26, 28 and 30 may be positioned between a pair of consecutive blade retention members. For example, the blade member 30 may be positioned between the first blade retention member 72 and the second blade retention member 74. The blade member 28 may be positioned between the second blade retention member 74 and the third blade retention member 76. The blade member 26 may be positioned between the third blade retention member 76 and the fourth blade retention member 78. The blade member 24 may be positioned between the fourth blade retention member 78 and the fifth blade retention member 80. The blade member 22 may be positioned between the fifth blade retention member 80 and the sixth blade retention member 82.

Figure 4A:
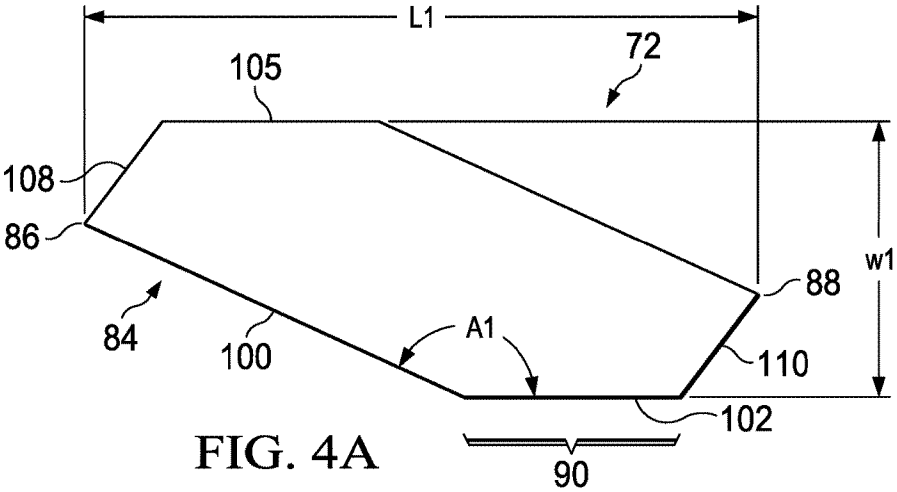
FIG. 4A is a top view of a first blade retention member of FIG. 3.
Figure 4B:
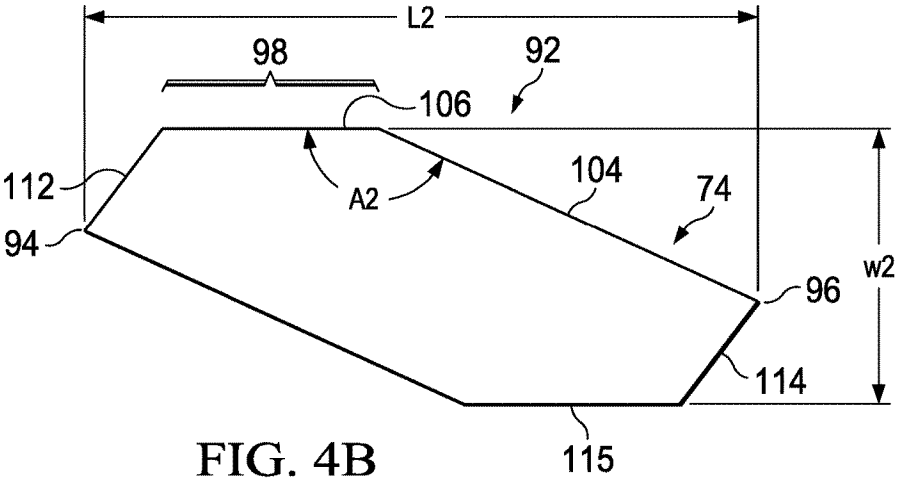
FIG. 4B is a top view of a second blade retention member of FIG. 3.

Referring to FIGS. 4A and 4B, a top view of the first blade retention member 72 and the second blade retention member 74 are shown, respectively. In certain embodiments, the first blade retention member 72 and the second blade retention member 74 may be the same size or shape (as shown). The first blade retention member 72 may have a front wall 84 with a first lateral end 86 and a second lateral end 88. A blade support region 90 between the first lateral end 86 and the second lateral end 88 may include a second wall 102 that contacts and supports the blade member 30 (FIG. 3) during shaving. The second blade retention member 74 may have a rear wall 92 with a first lateral end 94 and a second lateral end 96. A blade support region 98 between the first lateral end 94 and the second lateral end 96 may include a second wall 106 that contacts and supports the blade member 30 (FIG. 3) during shaving. In certain embodiments, the front wall 84 may be formed by a first wall 100 and the second wall 102 that define an obtuse included angle "A1". The second wall 102 may include the blade support region 90. Similarly, the rear wall 92 may be formed by a first wall 104 and the second wall 106 define an obtuse included angle "A2". The blade support regions 90 and 98 (i.e., the second walls 102 and 106) may have a contact length of about 0.2 mm to about 1.0 mm and preferably about 0.3 mm to 0.6 mm. The increased contact length (e.g., the length of the second wall 102 or the second wall 106 contacts one of the blade members 22, 24, 26, 28 and 30) may provide for improved blade security and decreased blade movement during shaving, resulting in a more comfortable and efficient shave. The obtuse angles A1 and A2 may facilitate easier blade member assembly, which may become more difficult as the contact length of the second walls 102 and 106 increases. The blade retention member 72 may have a length "L1" and the blade retention member 74 may have a length "L2". The length "L1" may be a horizontal distance extending between lateral ends 86 and 88. The length "L2" may be a horizontal distance extending between lateral ends 94 and 96. The lengths "L1" and "L2" may be about 1 mm to about 3 mm and preferably about 1.5 mm to about 2.5 mm. In certain embodiments, a ratio of the contact length of one of the blade support regions 90 and 98 (i.e., second walls 102 and 106) to the corresponding length "L1" and "L2" may be about 1:3 to about 1:10 and preferably about 1:3 to about 1:5.

The first blade retention member 72 may have a first lateral end wall 108 extending from the first lateral end 86 and away from the first wall 100. The first blade retention member 72 may have a second lateral end wall 110 extending between the blade support region 90 (and second wall 102) and the lateral end 88. The first lateral end wall 108, the second lateral end wall 110 and the first wall 100 may act as relief walls (e.g., they do not contact a blade member) to facilitate loading of the blades between the blade retention members 72 and 74. In addition, the first lateral end wall 108, the second lateral end wall 110 may provide sufficient rigidity to the first blade retention member 72 and thus prevent deflection or distortion which may result in unwanted blade movement.

The second blade retention member 74 may have a first lateral end wall 112 extending between the blade support region 98 (second wall 106) and the first lateral end 94. The second blade retention member 74 may have a second lateral end wall 114 extending from the second lateral end 96 and away from the first wall 104. The first wall 104, the first lateral end wall 112 and the second lateral end wall may act as relief walls (e.g., they do not contact a blade member) that facilitate loading of the blades between the blade retention members 72 and 74. Furthermore, the first lateral end wall 112 and the second lateral end wall 114 may provide sufficient rigidity to the second blade retention member 74 and thus prevent deflection or distortion, which may result in unwanted blade movement. In certain embodiments, the blade retention members 72 and 74 may have a respective width "w1" and "w2" of about 0.75 mm to about 1.25 mm. The width "w1" may be a vertical distance extending from the second wall 102 to a rear wall 105 of the first blade retention member 72. The rear wall 105 may be generally parallel to the second wall 102. The width "w2" may be a vertical distance extending from the second wall 106 to a front wall 115 of the second blade retention member 74. The front wall 115 may be generally parallel to the second wall 106.

Figure 5:
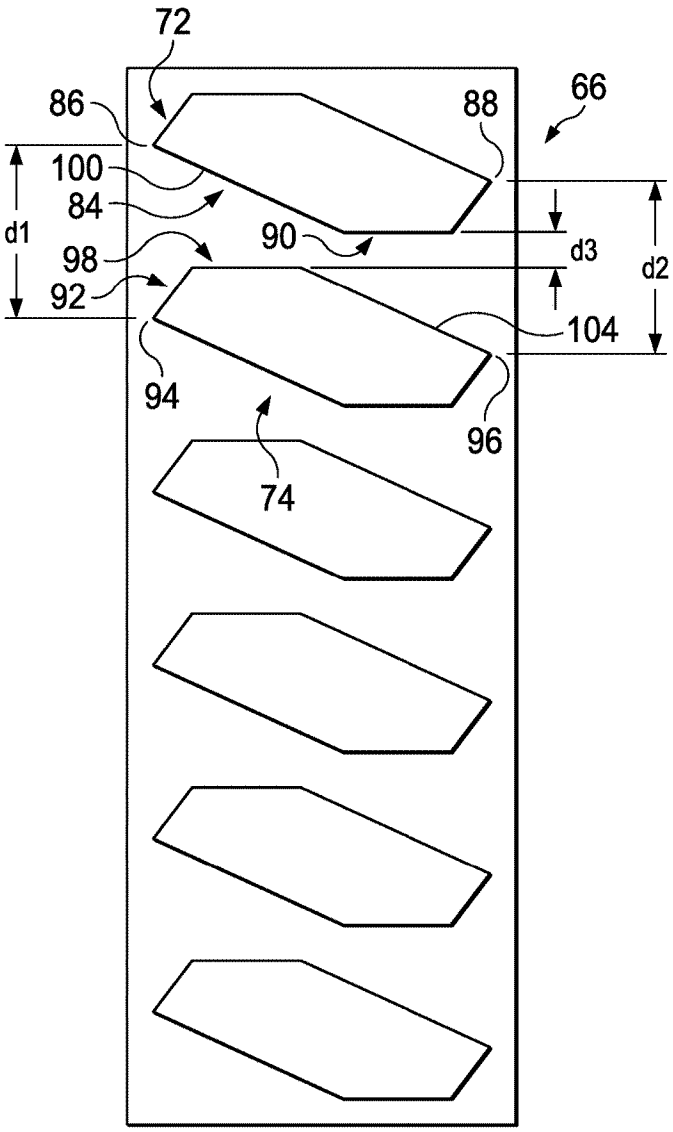
FIG. 5 is a top view of a blade platform of FIG. 3.

The blade retention members 72 and 74 are described in greater detail, referring to FIGS. 4A and 4B, in addition to FIG. 5, which illustrates a top view of the blade platform 66. The front wall 84 of the first blade retention member 72 may face the rear wall 92 of the second blade retention member 74. In certain embodiments, the rear wall 92 and the front wall 84 may be generally aligned (e.g., overlapping). For example, the blade support region 98 of the rear wall 92 may be offset from (e.g., not aligned with or overlapping) the blade support region 90 of the front wall 84. The blade support region 98 may be generally aligned with the first wall 100. The blade support region 90 may be generally aligned with the first wall 104. Accordingly, aligning the blade support regions 90 and 98 with a non-blade support surface or wall (e.g., the first wall 100 and the first wall 104), may facilitate positioning the respective blade members (e.g., blade member 30 of FIG. 3) between blade retention members 72 and 74, as well as, provide a more robust steel condition in the cavity of the injection mold that makes the housing 12 (FIG. 1).

The first lateral end 86 of the front wall 84 may be spaced apart from the first lateral end 94 of the rear wall by a first vertical distance "d1" of about 0.4 mm to about 1.8 mm. The second lateral end 88 of the front wall 84 may be spaced apart from the second lateral end 96 of the rear wall 92 by a second vertical distance "d2" of about 0.4 mm to about 1.8 mm. The blade support region 90 of the front wall 84 may be spaced apart from the blade support region 98 of the rear wall 92 by a third vertical distance "d3" of about 0.07 mm to about 0.38 mm. The third vertical distance may be less than both the first vertical distance and the second vertical distance to securely support the member blade 30 (FIG. 3). The larger first and second vertical distances may improve blade loading assembly, as well as provide for a more robust tooling steel design in the injection molding cavity that creates the housing 12 (FIG. 3).

Figure 6:
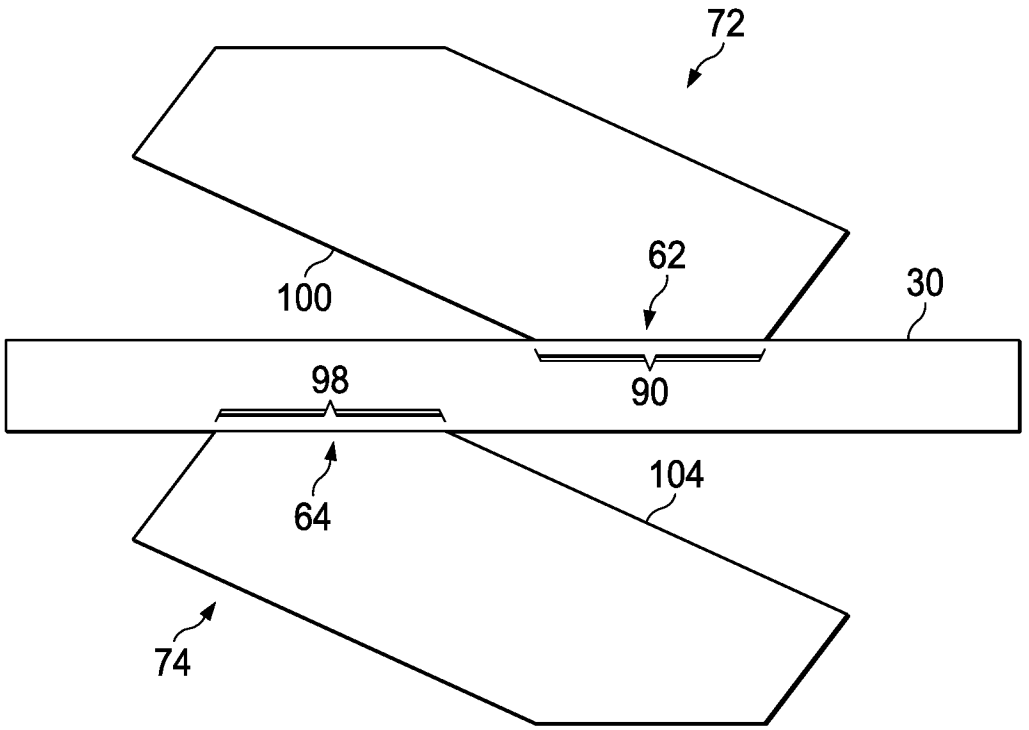
FIG. 6 is a top view of a blade member positioned between the first blade retention of FIG. 4A and the second blade retention member of FIG. 4B.

Referring to FIG. 6, a partial top view is shown detailing the blade member 30 positioned between the first and second blade retention members 72 and 74. The first blade support region 90 of the first blade retention member 72 may face and contact the first surface 62 of the blade member 30. The second blade support region 98 of the second blade retention member 74 may face and contact the second surface 64 of the blade member 30. The first surface 62 of the blade member 30 may be spaced apart from the wall 100. The second surface 64 of the blade member 30 may be spaced apart from the wall 104 of the second blade retention member 74. It is understood that the other blade members 22, 24, 26 and 28 (FIG. 3) may be positioned between respective blade retention members 74, 76, 78, 80 and 82 (FIG. 3) in the same manner as described for blade member 30. Furthermore, the blade platforms 68 and 70 may have a similar pattern of blade retention members as shown and described for blade platform 66 to facilitate the positioning and securing of the blade members 22, 23, 24, 26, 28 and 30 (FIG. 3).

Figure 7A:
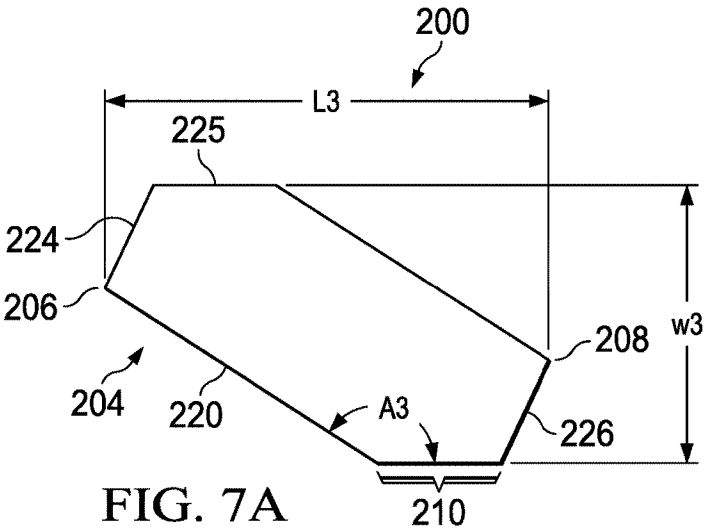
FIG. 7A is a top view of a second possible embodiment of a first blade retention member.
Figure 7B:
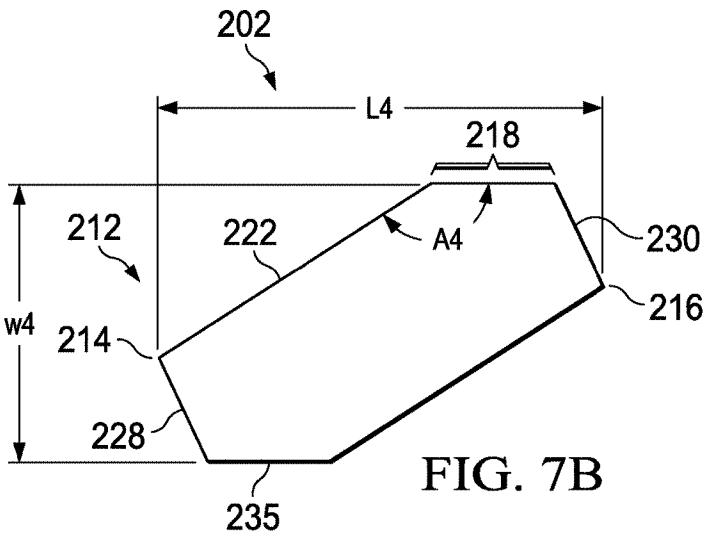
FIG. 7B is a top view of a second possible embodiment of a second blade retention member.

Referring to FIGS. 7A and 7B, alternative embodiments of a first blade retention member 200 and a second blade retention member 202 are illustrated. In certain embodiments, the first blade retention member 200 and the second blade retention member 202 may be the same size or shape, but they may be oriented differently with respect to each other (e.g., mirror images). The first blade retention member 200 may have a front wall 204 with a first lateral end 206, a second lateral end 208. A blade support region 210 between the first lateral end 206 and the second lateral end 208 may contact and support a blade member (not shown). It is understood the blade support region 210 may be a wall. The second blade retention member 202 may have a rear wall 212 with a first lateral end 214 and a second lateral end 216. A blade support region 218 between the first lateral end 214 and the second lateral end 216 may contact and support the blade member 30 (not shown). It is understood the blade support regions 210 and 218 may be generally parallel walls.

In certain embodiments, the front wall 204 of the first blade retention member 200 may be formed by a first wall 220 and the blade support region 210 that define an obtuse included angle "A3". Similarly, the rear wall 212 of the second blade retention member 202 may be formed by a first wall 222 and the blade support region 218 that define an obtuse included angle "A4". The obtuse angles "A3" and "A4" may facilitate loading of blade members by providing a larger opening between adjacent blade retention members 200 and 202, as well as, increase the size of the adjacent blade retention members 200 and 202. For example, an acute angle may decrease the size of the blade retention members 200 and 202, thus making them weaker. The first lateral end 206 may be positioned between a first lateral end wall 224 and the first wall 220 (e.g., an intersection between the first lateral end 224 wall and the first wall 220). A second lateral end wall 226 of the first blade retention member 200 may be positioned between the lateral end 208 and the blade support region 210. The first lateral end 214 of the second blade retention member 202 may be positioned between a first lateral end wall 228 and the first wall 222. A second lateral end wall 230 may be positioned between the blade support region 218 and the second lateral end 216.

The blade support regions 210 and 218 may have a contact length of about 0.2 mm to about 2.0 mm and preferably about 0.3 mm to 0.6 mm. The increased contact length may provide for improved blade security and decrease blade movement. The first blade retention member 200 may have a length "L3" that is a horizontal distance from the first lateral end 206 to the second lateral end 208. The second blade retention member 202 may have a length "L4" that is a horizontal distance extending from the first lateral end 214 to the second lateral end 216. The lengths "L3" and "L4" may be about 1 mm to about 3 mm and preferably about 1.5 mm to about 2.5 mm. In certain embodiments, a ratio of the contact length of the blade support regions 210 and 218 to the corresponding length "L3" or "L4" may be about 1:3 to about 1:10 and preferably about 1:3 to about 1:5. The first lateral end walls 224 and 228, the second lateral end walls 226 and 230 and the first walls 220 and 222 may act as relief walls (e.g., they do not contact the blade members) to facilitate loading of the blade members between the respective blade retention members 200 and 202. In addition, the first lateral end walls 206 and 228, the second lateral end wall 226 and 230 may provide sufficient rigidity to the respective first and second blade retention members 200 and 202 and thus prevent deflection or distortion which may result in unwanted blade member movement during shaving.

In certain embodiments, the blade retention members 200 and 202 may have a respective width "w3" and "w4" of about 0.75 mm to about 1.25 mm. The width "w3" may be a vertical distance extending from the blade support region 210 to a rear wall 225 of the first blade retention member 200. The rear wall 225 may be generally parallel to the blade support region 210. The width "w4" may be a vertical distance extending from the blade support region 218 to a front wall 235 of the second blade retention member 74. The front wall 235 may be generally parallel to the the second blade support region 218.

Figure 8:
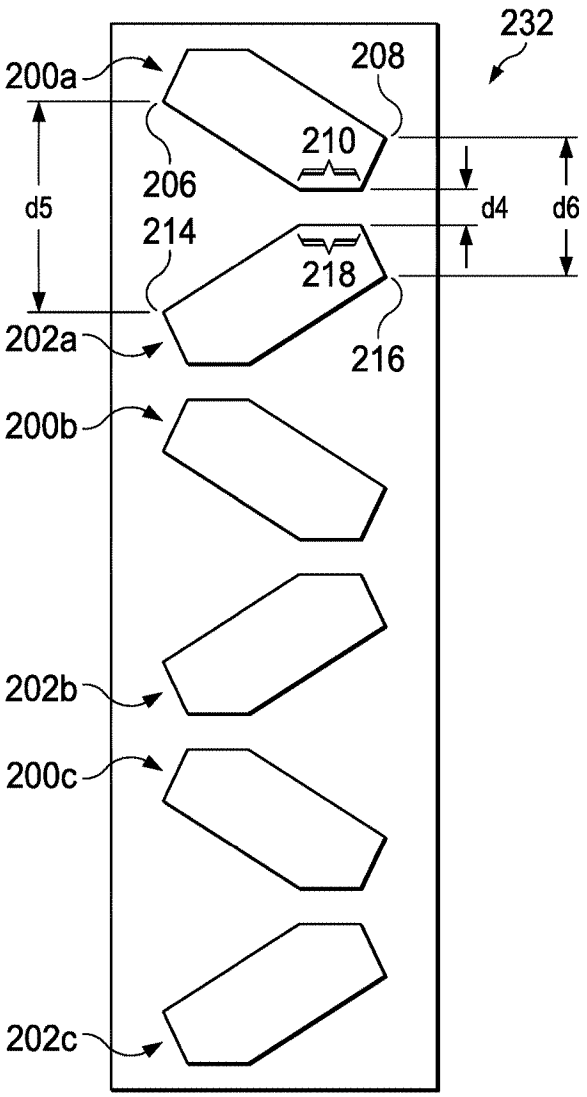
FIG. 8 is a top view of a second possible embodiment of a blade platform.

Referring to FIG. 8, a top view of another possible embodiment of a blade platform 232 having a plurality of first blade retention members 200*a*, 200*b*, 200*c* and second blade retention members 202*a*, 202*b* and 202*c*. In certain embodiments, the first blade retention members 200*a*, 200*b* and 200*c* may have the same orientation and mirror images of the second blade retention members 202*a*, 202*b* and 202*c*. The blade support regions 210 and 218 may face each other and may be generally aligned (e.g., overlapping). The blade support regions 210 and 218 may be spaced apart by a distance "d4" to receive a respective blade member (not shown). The first lateral end 206 may be spaced apart from the first lateral end 214 by a vertical distance "d5" of about of 0.4 mm to about 1.8 mm. The second lateral end 208 may be spaced apart from the second lateral end 216 by a vertical distance "d6" of about 0.4 mm to about 1.8 mm. The vertical distances d5 and d6 may be greater than the vertical distance d4 to facilitate loading and assembly of the blade members and provide a more robust steel condition in the cavity of the injection mold that creates the blade platform 232. The spacing of the respective distal ends 206, 214, 208 and 216 allows for a much larger open area on either side of blade support regions 210 and 218.

One or more of the blade first blade retention members 200*b*, 200*c* and second blade retention members 202*a*, 202*b* may support more than one blade; however, only one blade member may be positioned between a single pair of blade retention members. For example, the second blade retention member 202*a* may include both the blade support region 218 to support one blade member and another blade support region (e.g., wall 235) to support another blade member (not shown). One of the blade support regions 218 may contact or support a front side of one blade member and the other blade support region 235 may support a rear side of another blade member. The two blade support regions 218 and 235 positioned on the same blade retention member (e.g., blade retention member 202*a*) may be offset from each other in both a horizontal and a vertical direction to provide sufficient support and spacing of the blade members. This may be accomplished by orienting the first blade retention members 200*a*, 200*b*, 200*c* and second blade retention members 202*a*, 202*b* and 202*c* in an alternating manner. For example, one of the second blade retention members 202*a*, 202*b*, 202*c* may be positioned between two of the first blade retention members 200*a*, 200*b*, 200*c* on the blade support 232.

Figure 9:
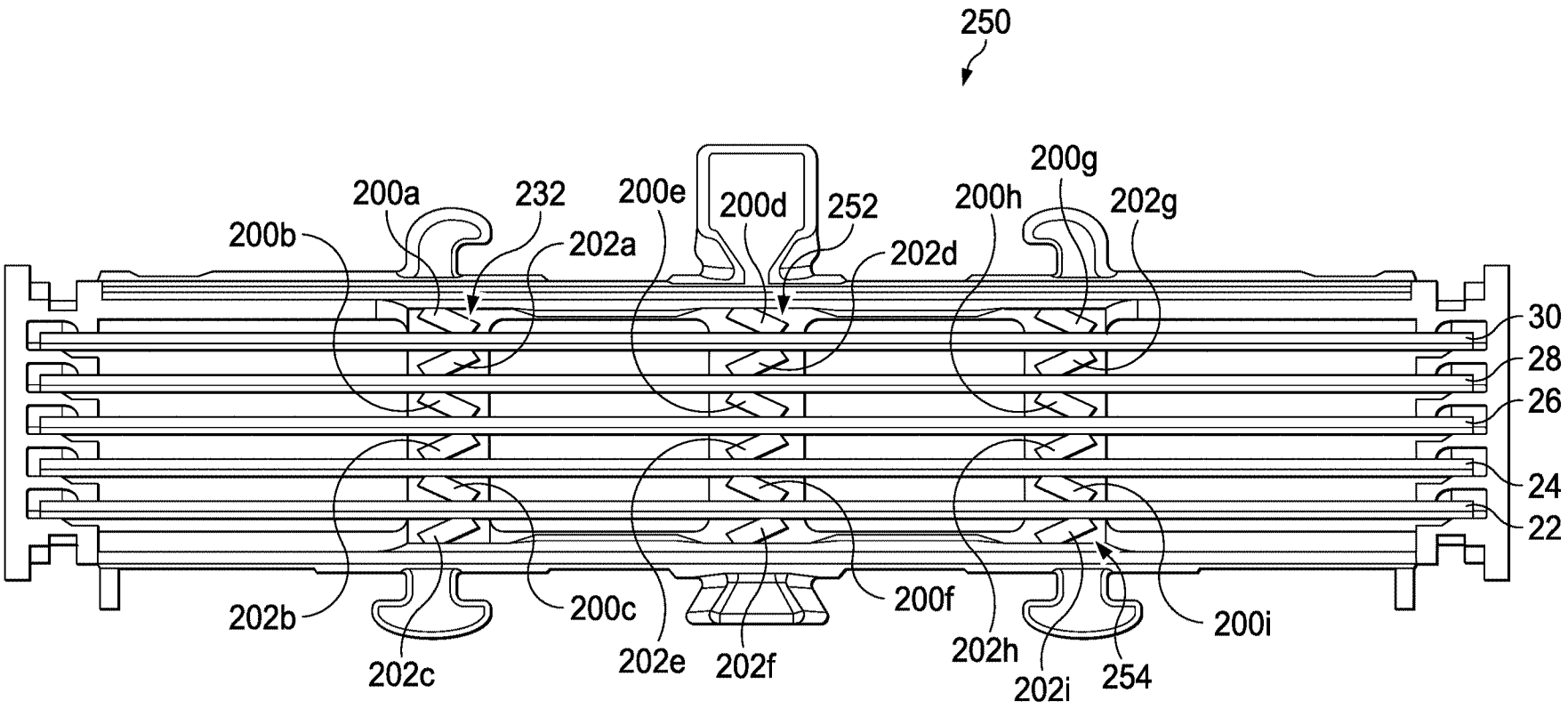
FIG. 9 is a top view of a second possible embodiment of a housing with a plurality of blade members that may be incorporated into the shaving razor cartridge of FIG. 1.

Referring to FIG. 9, a top view of another embodiment of a housing 250 is shown that may be incorporated into the shaving razor cartridge 10 of FIG. 1. The housing 250 may include a plurality of blade platforms 232, 252 and 254. Each of the blade platforms 252 and 254 may have a plurality of first blade retention members 200*d*, 200*e*, 200*f*, 200*g*, 200*h* and 200*i* and second blade retention members 202*d*, 202*e*, 202*f*, 202*g*, 202*h* and 202*i* arranged in a similar manner as previously described for the blade platform 232 having the first blade retention members 200*a*, 200*b* and 200*c* and the second blade retention members 202*a*, 202*b*, and 202*c*. For example, the blade platform 252 may comprise the first blade retention members 200*d*, 200*e* and 200*f* arranged in an alternating fashion with second blade retention members 202*d*, 202*e* and 202*f* (e.g., one of the second blade retention members 202*d* may be positioned between two of the first blade retention members 200*d* and 200*e*). The blade platform 254 may comprise the first blade retention members 200*g*, 200*h* and 200*i* arranged in an alternating fashion with second blade retention members 202*g*, 202*h* and 202*i* (e.g., one of the second blade retention members 202*g* may be positioned between two of the first blade retention members 200*g* and 200*h*). Each of the blade members 22, 24, 26, 28 and 30 may be supported by one or more blade retention members on a front side and one or more blade retention members on a rear side. For example, the blade member 30 may be supported on the first surface 62 by the blade retention members 200*a*, 200*d* and 200*g* and on the second surface 64 by the blade retention members 202*a*, 202*d* and 202*g*. It is understood that more or less blade retention members may be used depending on the desired level of rigidity of the blade members 22, 24, 26, 28 and 30, which may be impacted by factors such thickness of the blade members 22, 24, 26, 28 and 30.

Figure 10:
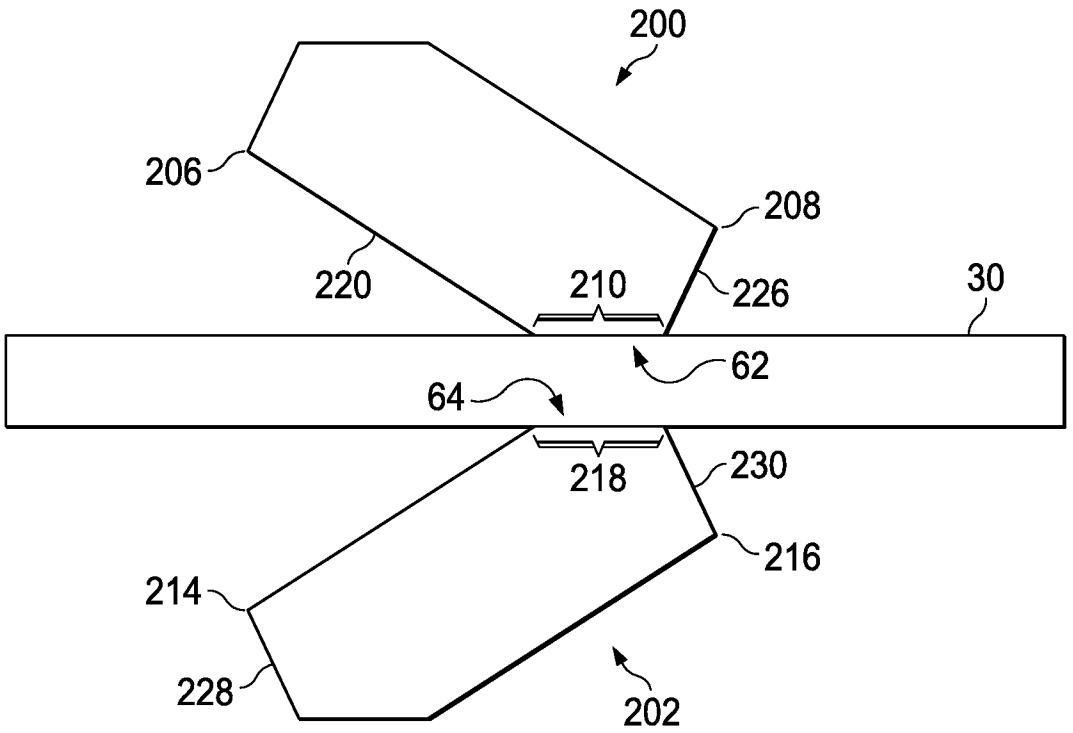
FIG. 10 is a top view of a blade member positioned between the first blade retention of FIG. 7A and the second blade retention member of FIG. 7B.

Referring to FIG. 10, a top view of the blade member 30 positioned between the first blade retention member 200 of FIG. 7A and the second blade retention member 202 of FIG. 7B is shown. The first blade support region 210 of the first blade retention member 200*a* may face and contact the first surface 62 of the blade member 30. The second blade support region 218 of the second blade retention member 202*a* may face and contact the second surface 64 of the blade member 30. The first surface 62 of the blade member 30 may be spaced apart from the wall 220. The second surface 64 of the blade member 30 may be spaced apart from the wall 214 of the second blade retention member 202*a*. The walls 220 and 214 be angled relative to each other (not parallel), thus facilitating blade member loading (positioning of blade members between a pair of blade retention members). Similarly, the walls 208 and 230 may be angled relative to each other (not parallel) to facilitate positioning the blade members between respective blade support regions (e.g., blade member 30 positioned between the blade support regions 210 and 218). In certain embodiments, the walls 220 and 228 (and the walls 208 and 230) may be slanted relative to each other at an included angle of about 10 degrees to about 120 degrees.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor cartridge comprising:

a housing comprising having a blade platform comprising:

a first blade retention member comprising a first lateral end, a second lateral end, a front wall, a first lateral end wall, and a second lateral end wall, wherein the front wall and the second lateral end wall are disposed between the first lateral end and the second lateral end, the front wall comprising a first wall and a second wall, wherein the first wall and the second wall define an obtuse angle, the second wall defining a blade support region between the first lateral end and the second lateral end of the first blade retention member, wherein the first wall and the second lateral end wall are relief walls having no portion coplanar with the blade support region, wherein the first lateral end wall extends from the first lateral end and away from the first wall, and wherein the second lateral end wall (i) extends from the second wall to the second lateral end, and (ii) is not parallel to the second wall; and a second blade retention member comprising a first lateral end, a first lateral end wall, a rear wall, a second lateral end, and a second lateral end wall, wherein the first lateral end wall of the second blade retention member and the rear wall are disposed between the first lateral end of the second blade retention member and the second lateral end of the second blade retention member, the rear wall facing the front wall of the first blade retention member, the rear wall comprising a first wall and a second wall, the second wall of the rear wall defining a blade support region between the first lateral end of the rear wall of the second blade retention member and the second lateral end of the rear wall of the second blade retention member, wherein the first wall of the rear wall extends between the second wall and the second lateral end of the second blade retention member, wherein no portion of the second wall of the front wall is parallel to the first wall of the rear wall, and wherein the first lateral ends are spaced apart by a first vertical distance, the second lateral ends are spaced apart by a second vertical distance and the blade support regions are spaced apart by a third vertical distance that is less than the first vertical distance.

2. The shaving razor cartridge of claim 1 further comprising a blade member positioned between the blade support regions.

3. The shaving razor cartridge of claim 2 wherein the third vertical distance is less than the second vertical distance.

4. The shaving razor cartridge of claim 2 wherein the blade member has a first surface contacting the blade support region of the first blade retention member and wherein the blade member has a second surface contacting the blade support region of the second blade retention member.

5. The shaving razor cartridge of claim 2 wherein the first and second walls of the rear wall form an obtuse included angle.

6. The shaving razor cartridge of claim 2 wherein the first wall of the rear wall comprises a relief wall and the first wall of the front wall comprises a relief wall.

7. The shaving razor cartridge of claim 6 wherein a plane of the second wall of the front wall and a plane of the second wall of the rear wall are parallel.

8. The shaving razor cartridge of claim 7 wherein a plane of the relief wall of the front wall intersects a plane of the relief wall of the rear wall.

9. The shaving razor cartridge of claim 2 wherein the first vertical distance is 0.40 mm to 1.80 mm.

10. The shaving razor cartridge of claim 9 wherein the second vertical distance is 0.40 mm to 1.90 mm.

11. The shaving razor cartridge of claim 10 wherein the third vertical distance is 0.075 mm to 0.40 mm.

12. The shaving razor cartridge of claim 1 wherein the first vertical distance is different from the second vertical distance.

13. A shaving razor cartridge comprising:

a housing having a blade platform;

a first blade retention member positioned on the blade platform and having a front wall formed by a first wall and a second wall that define an obtuse included angle, wherein the first blade retention member has a first lateral end and a second lateral end;

a second blade retention member positioned on the blade platform and having a rear wall facing the front wall of the first blade retention member, the rear wall having a first wall and a second wall that define an obtuse included angle, wherein the second blade retention member has a first lateral end and a second lateral end, and wherein a first vertical distance between the second walls is less than both a second vertical distance between the first lateral end of the first blade retention member and the first lateral end of the second blade retention member and a third vertical distance between the second lateral end of the first blade retention member and the second lateral end of the second blade retention member;

wherein no portion of the second wall of the front wall is parallel to the first wall of the rear wall; and a blade member positioned between the front wall and the rear wall, wherein the second walls have a contact length of 0.2 mm to 1.0 mm.

14. The shaving razor cartridge of claim 13 wherein the contact length is 0.3 mm to 0.6 mm.

15. The shaving razor cartridge of claim 13 wherein a ratio of the contact length of at least one of the second walls to a corresponding blade retention member of the first and second blade retention member is 1:3 to 1:10.

16. The shaving razor cartridge of claim 15 wherein the ratio of the contact length of at least one of the second walls to the corresponding blade retention member length is 1:3 to 1:5.

17. The shaving razor cartridge of claim 13 wherein the second walls are offset from each other.

* * * * *